United States Patent [19]

McClosky

[11] 4,398,634

[45] Aug. 16, 1983

[54] CHILD-PROOF PACKAGE SYSTEM

[75] Inventor: Robert B. McClosky, Hope, N.J.

[73] Assignee: Wrapade Machine Company, Inc., Clifton, N.J.

[21] Appl. No.: 320,756

[22] Filed: Nov. 12, 1981

[51] Int. Cl.[3] ..... B65D 83/04; B65D 85/56

[52] U.S. Cl. ..... 206/532; 206/534.1; 206/484; 206/807; 206/820

[58] Field of Search ..... 206/532, 534.1, 534.2, 206/484, 807, 820, 604, 620, 345, 390

[56] References Cited

U.S. PATENT DOCUMENTS 3,503,493 3/1970 Nagy ..... 206/484

3,809,220 5/1974 Arcudi ..... 206/484

FOREIGN PATENT DOCUMENTS 624117 2/1963 Belgium ..... 206/820

*Primary Examiner*—William T. Dixson, Jr.

*Assistant Examiner*—Brenda J. Ehrhardt

*Attorney, Agent, or Firm*—Martin L. Faigus

[57] ABSTRACT

A sealed package system includes multiple sealed units separably interconnected to each other by tear lines, said units including opposed, substantially planar, tear-resistant flexible plastic sheets sealed to each other, preferably by heat sealing, about peripheral seal zones of the units to provide each unit with a central compartment adapted to retain and protect a material therein, seal zones between adjacent compartments including the tear lines for permitting separation of discrete sealed units from each other without disrupting the sealed integrity of the compartments thereof, each tear line including a substantially linear, continuous slit uninterrupted by bridge areas and being linearly aligned with the compartments in adjacent units interconnected by said tear line, the linear dimension of each of said continuous slits being greater than the greatest linear dimension of the linearly aligned compartments, as measured substantially parallel to said continuous slit.

4 Claims, 5 Drawing Figures

CHILD-PROOF PACKAGE SYSTEM

FIELD OF THE INVENTION

This invention relates to a package system, and more specifically to a child-proof package system including individual, sealed packages or units separably interconnected to each other.

BACKGROUND ART

There is a continuing concern in the drug industry to package medications in a manner which will prevent easy access to them by children. The reason for this concern is obvious. If a package containing medications can be opened easily by a child, a serious risk of overdose exists. This can result in severe harm, or even death to the child.

It is known to package tablets, capsules and similar medications in pockets formed between flexible plastic sheets or films that are heat sealed, or otherwise secured together. Generally a plurality of individual units are separable from each other along lines of perforations. One such package is disclosed in U.S. Pat. No. 3,809,220, issued to Arcudi. The package disclosed in Arcudi is formed between opposed flexible plastic sheets, and includes a hidden tear zone, in the form of a slit located inwardly of the package's marginal edges. The slit is exposed by bending the package to thereafter permit easy opening of a central compartment in which the drug is packaged. As disclosed in Arcudi, individual packages are separably interconnected by lines of perforations. These lines of perforations include tabs, or bridge areas between discrete cuts, and these bridge areas are linearly aligned with the medicant-retaining compartment, or pocket in the adjacent and interconnected packaging unit. That is, projections perpendicular to the tabs or bridge areas intercept the tablet compartments.

It has been found that when tabs or bridge areas exist, they tend to become weakened areas in individual packages that are separated from the group. These tabs become weakened as a result of the tearing that takes place through them when the individual packages are separated. Apparently tearing through each bridge area provides a roughened edge that acts as a force-concentrating region when a child applies a tearing force to the edge of the package. It also has been found that notches or tears directed inwardly toward the medicant-retaining compartment can be formed at the junction of the bridge areas with slits or cuts of conventional lines of perforations. These notches or tears, once formed, can easily propagate, or be torn into the medicant-retaining compartment. Thus, even though the initially formed package system may have been child-proof, or tear-resistant, separation of an individual package along a line of perforations destroys this attribute.

U.S. Pat. No. 3,503,493, issued to Nagy, discloses a package that employs a blister 22 formed of relatively stiff material, such as polystyrene. This blister includes a depressed portion 23 to contain a drug therein. A flexible planar sheet material is sealed over the depressed portion to enclose the drug. A plurality of individual packets are interconnected through severance lines. One of the lines is formed by a plurality of slits 49 interconnected by tabs 51. Although it appears that the tabs may not be in linear alignment with the depressed portions 23 of the interconnected package units, there is actually no mention of the positional relationship of the slits and tab regions relative to the pockets or depressions 23 in the interconnected package units. Moreover, packages of the type disclosed in Nagy, i.e. those including a relatively stiff blister, do not pose the same child-access problems that are encountered in packaging systems formed between opposed, flexible planar plastic sheets. It is to these latter systems that the instant invention is directed. Stating this another way, the relationship of the slits 49 and interconnecting tabs 51 in the severance line relative to the pocket in the plastic blister has absolutely no effect on the child-resistant properties of the Nagy package. In Nagy the blister 22 is relatively stiff, and should be capable of adequately resisting a lateral tearing force imparted to the package by a child to prevent the child from tearing the package and gaining access to the drug. In Nagy the depressed compartment 23 is exposed by peeling the flexible cover sheet therefrom; not by tearing the package inwardly from the marginal edge in the manner employed to open packages formed by opposed, flexible planar sheets.

The following patents disclose various types of packaging systems; however, none of them deal with, or recognize the problem of the destruction of the tear-resistant properties of the package resulting from separating individual package units along interconnecting lines of perforations:

U.S. Pat. No. 3,809,221—Compere
U.S. Pat. No. 3,924,746—Haines
U.S. Pat. No. 3,941,248—Moser et al
U.S. Pat. No. 4,011,949—Braber et al

SUMMARY OF THE INVENTION

A child-proof, sealed package system including multiple sealed units separably interconnected to each other, each of said units including opposed, substantially planar tear-resistant flexible plastic sheets sealed to each other around a peripheral zone to provide an unsealed, central material-containing compartment therein; seal zones between adjacent compartments including tear lines in them for permitting separation of discrete sealed units from each other without disrupting the sealed integrity of the material-containing compartments. Each tear line includes a substantially linear continuous slit uninterrupted by bridge areas, said slit being linearly aligned with the material-containing compartments in adjacent units interconnected by the tear line, the linear dimension of each of said slits being greater than the greatest linear dimension of the linearly aligned compartments, as measured substantially parallel to said slit, whereby roughened bridge areas are avoided in areas of the package linearly aligned with the material-containing compartments.

In this invention applicant has discovered that by eliminating tab or bridge areas in regions of the lines of perforations linearly aligned with the pockets, the packaging system possesses child-resistant properties that otherwise were not attainable. In other words, similar systems provided with conventional lines of perforations have failed to meet the child-resistant properties achieved by the package system of the instant invention.

In the most preferred embodiment of this invention the package system includes at least four sealed units positioned in a square array, and the tear lines interconnecting these four units include continuous slits that terminate short of the center of the array to provide an uncut central region for enhancing the strength and integrity of the package. Applicant has found that this uncut region can be provided while still permitting easy separation of the individual units from the array, and without destroying the package's tear-resistant properties. In many instances it is necessary to provide the uncut central region to enhance the strength of the interconnected packaging units so that they can be handled during the final packaging operations without individual units thereof separating from the system.

Other objects and advantages of this invention will become apparent by referring to the Description of the Preferred Embodiment of the Invention which follows, taken in conjunction with the drawings.

DESCRIPTION OF THE PREFERRED EMBODIMENT OF THE INVENTION

Figure 2:
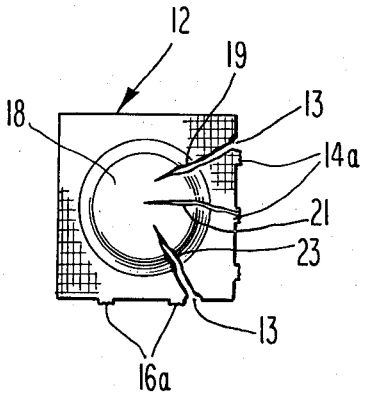
PRIOR ART Fig. 2
FIG. 2 shows one of the individual units illustrated in FIG. 1 removed from the array and depicting the damaged bridge areas created by separating the unit along its interconnecting line of perforations, and illustrating the manner in which a tear can propagate from a damaged bridge area into the article-retaining compartment.

Although specific terms are used in the following description for the sake of clarity, these terms are intended to refer only to the particular structure of the invention selected for illustration in the drawings, and are not intended to define or limit the scope of the invention.

Figure 1:
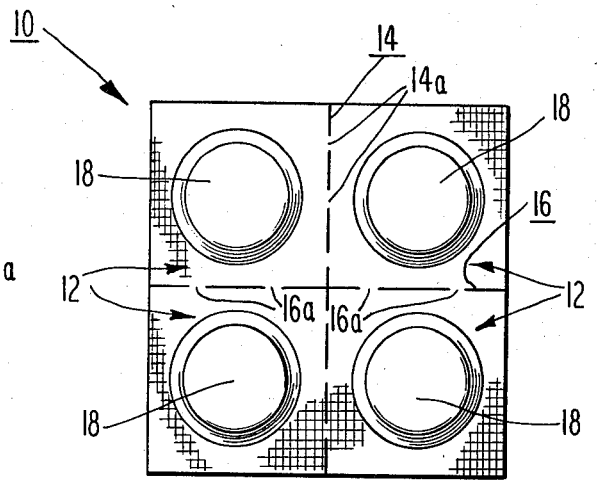
PRIOR ART Fig. 1
FIG. 1 is a plan view of a prior art package system including four discrete units disposed in a square array.

In order to fully understand the present invention, a brief discussion of the prior art constructions is believed to be helpful. Referring to FIGS. 1 and 2, a prior art sealed package system 10 includes a plurality of individual sealed units 12 interconnected by conventional lines or perforations 14 and 16. The system illustrated in FIGS. 1 and 2 is of the type disclosed in U.S. Pat. No. 3,809,220, issued to Arcudi, and herein incorporated by reference.

Referring to FIG. 2, uncut tab, or bridge areas **14*a* and 16*a* of the lines of perforations 14 and 16 become ragged when an individual unit 12 is separated from the system. Separation of a unit 12 from the system also can create a notch or tear 13 at the junction of the bridge areas 14*a*, 16*a*, with the slits or cuts of their respective lines of perforations. The ragged areas, as well as the notches 13, constitute weakened regions at which the individual unit 12 is most susceptible to tearing. Different ways in which tears can be formed, or caused to propagate into a centrally located article-containing compartment 18 in the prior art package 10 are illustrated at 19, 21 and 23 in FIG. 2**. These tears can be provided too easily by a child.

Figure 4:
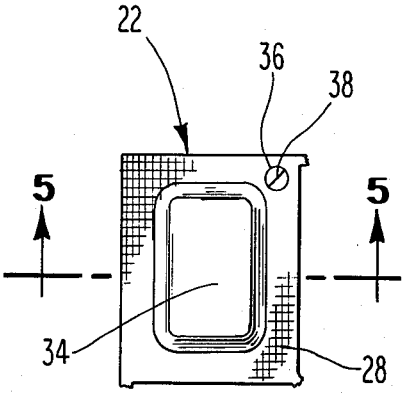
FIG. 4 illustrates a single package unit of the system illustrated in FIG. 3, but separated from the system.
Figure 3:
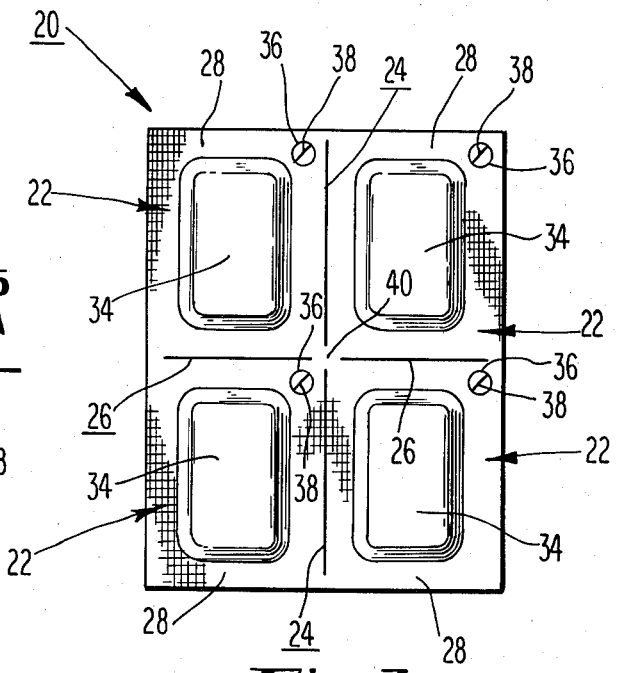
FIG. 3 is a plan view of a package system in accordance with this invention.
Figure 5:
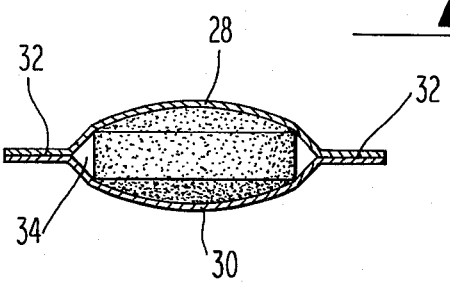
FIG. 5 is a sectional view along line 5—5 of FIG. 4.

Turning now to FIGS. 3–5, the sealed package system 20 of this invention includes a plurality of individual, sealed packages, or units 22 separably interconnected to each other along discrete tear lines 24 and 26 that are mutually perpendicular to each other. The package system 20 of this invention is provided by opposed, substantially planar plastic sheets 28 and 30 that are heat sealed to each other around a peripheral seal zone 32 of each of the individual units 22 to thereby define a centrally located article-containing pocket or compartment 34 in each of these units.

The plastic employed in this invention must be tear-resistant, i.e. it must resist tearing from the marginal edges thereof. In addition, the plastic material should be flexible, and preferably liquid impervious so that the individual units can be bent without rupturing of the package, and to maintain the medicant, or other article stored in the individual pockets or compartments in a protected environment. A preferred material for use in this invention is a polyester film, sold under the trademark MYLAR. In some embodiments the flexible planar sheet material is a laminate; including an outer MYLAR layer to provide the necessary tear-resistant properties, a central foil layer bonded to the MYLAR layer by any suitable adhesive, such as molten polyethylene, to enhance the moisture and oxygen-resistant properties of the system, and an internal heat-sealable plastic layer (e.g. polyethylene, or any number of similar plastics) adapted to be employed to heat seal the opposed sheets to each other about the peripheral seal zone 32. However, for many applications the foil layer is, or can be omitted.

As can be seen in FIGS. 3 and 4, the discrete units 22 are of the type disclosed in FIGS. 10 and 11 of Arcudi U.S. Pat. No. 3,809,220; said patent already having been incorporated herein by reference. In particular, each of the units includes a hidden tear zone 36 located inwardly of marginal edges of the unit, and this zone includes an aperture, or slit 38. Due to the flexible nature of the individual units 22, the corner of the unit can be bent to provide access to the tear zone for permitting the package to be opened to remove the medicant. However, unless a child knows to bend the edge of the unit, it will not be able to gain access to the interior compartment merely by attempting to tear the unit from a marginal edge thereof, especially when employing the unique features of the instant invention, as will be described in detail hereinafter.

Referring specifically to FIGS. 3 and 4, each of the tear lines 24 and 26 is in the form of a substantially linear, continuous slit, uninterrupted by any tabs or bridge areas in regions linearly aligned with the pockets 34 of the units 22 interconnected by the tear line. The continuous slits are actually linearly aligned with these latter-mentioned pockets 34, and the linear dimension of each of the slits is greater than the greatest linear dimension of said linearly aligned compartments, as measured in a direction substantially parallel to said slit. In the illustrated embodiment, the article-containing pocket 34 is substantially rectangular, and therefore, the linear dimension of the pocket, as measured substantially parallel to the slit 24 is constant, regardless of where along the compartment the measurement is taken. In a representative embodiment of this invention, the long dimension of the rectangular compartment is approximately $1\frac{1}{8}$ inches, and the narrow dimension is approximately $\frac{3}{4}$ of an inch. The slit of the tear line 24 aligned with the long dimension of the compartment is approximately $1\frac{3}{8}$ inches in length, and the slit of the tear line 26 aligned with the narrower dimension of the compartment is approximately 1.06 inches in length.

It should be understood that this invention is not limited to packaging systems wherein the individual units have rectangular article-containing pockets, or compartments. The invention is equally applicable to systems wherein the individual units have circular, oblong or other shaped pockets. However, in all embodiments of this invention the linear dimension of the continuous slit that is linearly aligned with the pocket is greater than the greatest linear dimension of said pocket, as measured substantially parallel to said slit. For example, if the pocket is circular in plan view, the slit linearly aigned with it has a length greater than the diameter of the pocket.

Applicant has found, quite surprisingly, that the elimination of the tabs, or brige areas in linear alignment with the article-retaining pockets in the discrete units 22 eliminates the creation of weakened regions that prevent the packaging system 20 from passing desired child-proof test procedures.

As can be seen in FIG. 3, each of the continuous slits forming the discrete tear lines 24 and 26 terminates short of the center of the square array, and thereby provide a central uncut bridge region 40 to enhance the integrity of the package system 20. This is very desirable as the system 20 is being handled in subsequent packaging operations. Moreover, it has been found that when tearing into the central bridge region 40 from one of the slits, say slit 24, to separate a unit 22 from the package 20, any tearing in said central region tends to propagate into an adjacent slit, rather than into a compartment 34, to thereby perserve the child-proof properties of the unit.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A sealed package system including multiple sealed units separably interconnected to each other, said units including opposed, substantially planar tear-resistant flexible plastic sheets sealed to each other around a peripheral zone to provide a central article-containing compartment therein; seal zones between adjacent compartments including substantially linear tear lines along which the individual units are separable without disrupting the integrity of the sealed compartments thereof, each tear line including a substantially linear, continuous slit uninterrupted by bridge areas and being linearly aligned with compartments in adjacent units interconnected by said tear line, the linear dimension of each of said slits being greater than the greatest linear dimension of the linearly aligned compartments, as measured substantially parallel to said slits, whereby uncut bridge areas are not in linear alignment with adjacent compartments.

2. The sealed package system of claim 1 having a tear means including an aperture positioned inwardly of sealed marginal edges thereof, said packaging system being foldable along a line to expose said aperture for permitting tearing of each unit into the compartment thereof for removal of material packaged therein.

3. The sealed package system of claim 1 wherein the opposed flexible plastic sheets include polyester.

4. The sealed package system of claim 1 wherein multiple sealed units include four of such units in a square array, tear lines interconnecting said four units including continuous slits uninterrupted by bridge areas and being linearly aligned with compartments in adjacent units interconnected by said tear lines, the linear dimension of each of said slits being greater than the greatest linear dimension of the linearly aligned compartments, as measured substantially parallel to said slit, each of said slits terminating short of the central region of the array to provide an uncut central region for enhancing the integrity of the package system.

* * * * *